US005843303A

United States Patent [19]

Ganeshan

[11] Patent Number: 5,843,303

[45] Date of Patent: Dec. 1, 1998

[54] DIRECT FIRED CONVECTION HEATING IN RESIDUUM OIL SOLVENT EXTRACTION PROCESS

[75] Inventor: Ram Ganeshan, Sugarland, Tex.

[73] Assignee: The M. W. Kellogg Company, Houston, Tex.

[21] Appl. No.: 925,211

[22] Filed: Sep. 8, 1997

[51] Int. Cl.[6] ..... C10C 3/00

[52] U.S. Cl. ..... 208/309; 208/320; 208/427; 201/15; 201/14

[58] Field of Search ..... 208/309, 427, 208/320; 201/15, 14

[56] References Cited

U.S. PATENT DOCUMENTS

| | | | |
|---|---|---|---|
| 2,940,920 | 6/1960 | Garwin . | |
| 4,374,017 | 2/1983 | Barney | 208/11 R |
| 4,572,781 | 2/1986 | Krasuk | 208/309 |

OTHER PUBLICATIONS

A. H. Northup et al., "Advances in Solvent Deasphalting Technology," presented at the 1996 NPRA Annual Meeting, Mar. 17–19, Convention Center, San Antonio, Texas.

S.R. Nelson et al., "Rose®: The Energy–Efficient, Bottom–of–the–Barrel Alternative," presented at the 1985 Spring A.I.Ch.E. Meeting, Houston, Texas, Mar. 24–28, 1985.

*Primary Examiner*—Helane Myers
*Attorney, Agent, or Firm*—The M. W. Kellogg Company

[57] ABSTRACT

A residuum oil solvent extraction process is improved by using direct fired convection heaters for heating the asphaltene, the solvent-deasphalted oil phase, the deasphalted oil and the stripping steam, instead of hot oil heat exchangers. The convection heaters are fired using recirculated flue gas so that the hot flue gas supplied to the convection heaters has a temperature between 800° F. and 1400° F.

8 Claims, 2 Drawing Sheets

DIRECT FIRED CONVECTION HEATING IN RESIDUUM OIL SOLVENT EXTRACTION PROCESS

FIELD OF THE INVENTION

The present invention relates to an improvement in a residuum oil solvent extraction process, and more specifically to such an improvement where direct fired convection heating is used to heat various process streams.

BACKGROUND OF THE INVENTION

Solvent deasphalting has been known since the 1930's. Such processes are seen, for example, in U.S. Pat. No. 2,940,920, and publications such as A. H. Northup et al., "Advances in Solvent Deasphalting Technology," presented at the 1996 NPRA Annual Meeting, Mar. 17–19, 1996, Convention Center, San Antonio, Tex. and S. R. Nelson et al., "ROSE®: The Energy-Efficient, Bottom-of-the-Barrel Alternative," presented at the 1985 Spring A.I.Ch.E. Meeting, Houston, Tex., Mar. 24–25, 1985, all of which are hereby incorporated herein by reference. With the introduction of the commercially available ROSE® process technology, solvent deasphalting processes have become more energy efficient and cost effective. Solvent deasphalting technology is commonly used today as the primary bottom-of-the-barrel upgrader in a deep conversion refinery, and is also used to produce fluid catalytic cracker (FCC) feeds, lube bright stocks, deasphalted gas oil feeds for hydrotreating and hydrocracking units, specialty resins, and heavy fuel and asphalt blending components.

In the typical residuum oil solvent extraction process, the residuum oil is contacted with a light hydrocarbon solvent at an elevated subcritical pressure and temperature. The resulting mixture is separated into a solvent-deasphalted oil (DAO) phase and an asphaltene phase. The asphaltene phase is heated and then steam stripped to form an asphaltene product stream. The solvent-DAO phase is heated to above the equilibrium temperature of the solvent to effect separation of the solvent-DAO phase into a solvent phase and a DAO phase. The DAO phase is recovered, heated and steam stripped to form a DAO product stream. In some processes, an intermediate separation of resin can also be done at an increased temperature to obtain a resin fraction from the solvent-DAO phase prior to recovery of the DAO.

In any case, it is necessary to heat the asphaltene phase, the solvent-DAO phase and the DAO phase, and to superheat the steam used in the steam stripping of the asphaltene and DAO phases. Conventionally, a hot oil system has been used as a heating medium to supply the heat needed to raise the temperature of these process streams and the steam. Heating of the fluid streams is generally accomplished in several shell and tube heat exchangers.

Using the hot oil system is generally adequate and energy efficient; however, there is room for improvement. For example, the hot oil system requires a fired hot oil heater and considerable interconnecting hot oil piping. It would be desirable to use fewer pieces of equipment and reduce the heat losses from the interconnecting hot oil piping. It would also be desirable to improve the efficiency of the hot oil heater to save energy. It would further be desirable to have available a compact equipment arrangement, as well as to reduce capital and operating costs of the heating system. Conventional hot oil heater tube metallurgy has typically been a minimum of P5 material, but P9 tubes are being used more frequently because of polythionic acid corrosion in the hot oil tubes.

The temperature control of the process fluids being heated by the hot oil is also very critical because slight variations in the temperatures can result in the precipitation of asphaltenes, for example, which can foul and plug the heat exchanger tubes. Temperature control can often be difficult because the high temperature of the hot oil can lead to very rapid temperature changes. Therefore, a heating system for the asphaltene, solvent-DAO and DAO phases, with easier temperature control and better resistance to fouling and plugging would be desirable.

SUMMARY OF THE INVENTION

The present invention improves the residuum oil solvent extraction process by replacing the hot oil heating system with direct fired convection heating. This eliminates the hot oil piping, and reduces the number of pieces of equipment which are needed, particularly the heat exchangers. In turn, this eliminates all heat losses from the hot oil interconnect piping. The temperature of the flue gas can be reduced by recirculating the flue gas back to the combustion zone. This has the benefit of inhibiting deterioration of the process fluids (asphaltene, solvent-DAO and DAO phases) because the wall temperature of the tubes is lower. In addition, the diameter of the tubes in the convection heater are much larger, and dramatically reduce the likelihood of fouling or plugging of the diameter of the tubes. Milder operation enables better temperature control in the direct fired convection heater. Moreover, the levels of nitrogen oxide generated from the combustion of the fuel are lower because the temperature of the combustion products is lower in the direct fired heater due to recirculation of the cooled flue gases.

Accordingly, the present invention provides an improvement in a residuum oil solvent extraction process. The solvent extraction process includes the steps of 1) contacting residuum oil with a light hydrocarbon solvent at an elevated subcritical pressure and temperature, 2) separating a mixed solvent-deasphalted oil (DAO) phase from an asphaltene phase, 3) heating the asphaltene phase from step (2) and steam stripping the heated phase to form an asphaltene product stream, 4) heating the solvent-DAO phase from step (2) to above the equilibrium temperature of the solvent to effect separation of the solvent-DAO phase into a solvent phase and a DAO phase, 5) recovering the DAO phase, and 6) heating the DAO phase from step (5) and steam stripping the DAO phase to form a DAO product stream. The present improvement is effected by the heating in steps (3), (4) and (6) comprising the steps of:

(a) burning fuel and air in a combustion zone to mix with recirculated flue gas to form a hot flue gas;

(b) supplying the hot flue gas from step (a) to a convection heating zone;

(c) passing the asphaltene phase from step (2), the solvent-DAO phase from step (2), and the DAO phase from step (5) tubeside through the convection heating zone to heat the tubeside fluids and cool the flue gas;

(d) collecting the cooled flue gas from step (c) and recirculating a portion thereof to the combustion zone in step (a).

Preferably, the tubeside fluids and hot flue gas are passed through a plurality of respective convection heating sections operated in parallel. Step (3) of the solvent extraction process can include heating and recirculating a portion of the asphaltene product stream to the asphaltene stripping, wherein the recirculated asphaltene is heated by passage tubeside through the convection heating zone in step (c). The solvent extraction process can also include the step of (7)

superheating steam for stripping in steps (3) and (6), and the improvement can include superheating the steam by passage tubeside through the convection heating section in step (c). Preferably, the hot flue gas from step (a) has a temperature from 800° F. to 1400° F.

In a preferred embodiment, the present invention provides an improvement in a residuum oil solvent extraction process comprising the steps of 1) contacting residuum oil with a light hydrocarbon solvent at an elevated subcritical pressure and temperature, 2) separating a mixed solvent-deasphalted oil (DAO) phase from an asphaltene phase, 3) heating the asphaltene phase from step (2) to form a first hot asphaltene stream, 4) feeding the first hot asphaltene stream from step (3) to an asphaltene steam stripping unit to form an asphaltene product stream essentially free of solvent, 5) heating a portion of the asphaltene product stream from step (4) to form a second hot asphaltene stream, 6) feeding the second hot asphaltene stream to the asphaltene steam stripping unit in step (4), 7) heating the solvent-DAO phase from step (2) to above the equilibrium temperature of the solvent to effect separation of the mixed solvent-DAO phase into a solvent phase and a DAO phase, 8) recovering the DAO phase separated in step (7), 9) heating the DAO phase from step (8), 10) steam stripping the hot DAO phase from step (9) to form a DAO product stream essentially free of solvent, and 11) superheating steam for use in steps (4) and (10). The improvement is that the heating in steps (3), (5), (7), (9) and (11) comprises the steps of:

(a) burning fuel and air in a combustion zone to mix with recirculated flue gas to form a hot flue gas;

(b) supplying the hot flue gas from step (a) to a convection heating zone comprising a plurality of parallel convection heating sections;

(c) passing the asphaltene phase from step (2) tubeside through one of the convection heating sections to heat the asphaltene phase and cool the flue gas;

(d) passing the solvent-DAO phase from step (2) tubeside through one of the convection heating sections to heat the solvent-DAO and cool the flue gas;

(e) passing the solvent-lean DAO from step (8) tubeside through one of the convection heating sections to heat the DAO and cool the flue gas;

(f) passing the portion of the asphaltene product stream from step (4) tubeside through one of the convection heating sections to heat the asphaltene and cool the flue gas;

(g) passing steam tubeside through one of the convection heating sections to superheat the steam and cool the flue gas;

(h) collecting the cooled flue gas from the convection heating sections; and (i) recirculating a portion of the collected flue gas from step (h) to the combustion zone in step (a).

The hot flue gas from step (a) preferably has a temperature from 800° F. to 1400° F., and the tubes for the passage of the asphaltenes and steam in steps (f) and (g) are preferably arranged in series in one of the convection heating sections.

DETAILED DESCRIPTION OF THE INVENTION

Figure 1:
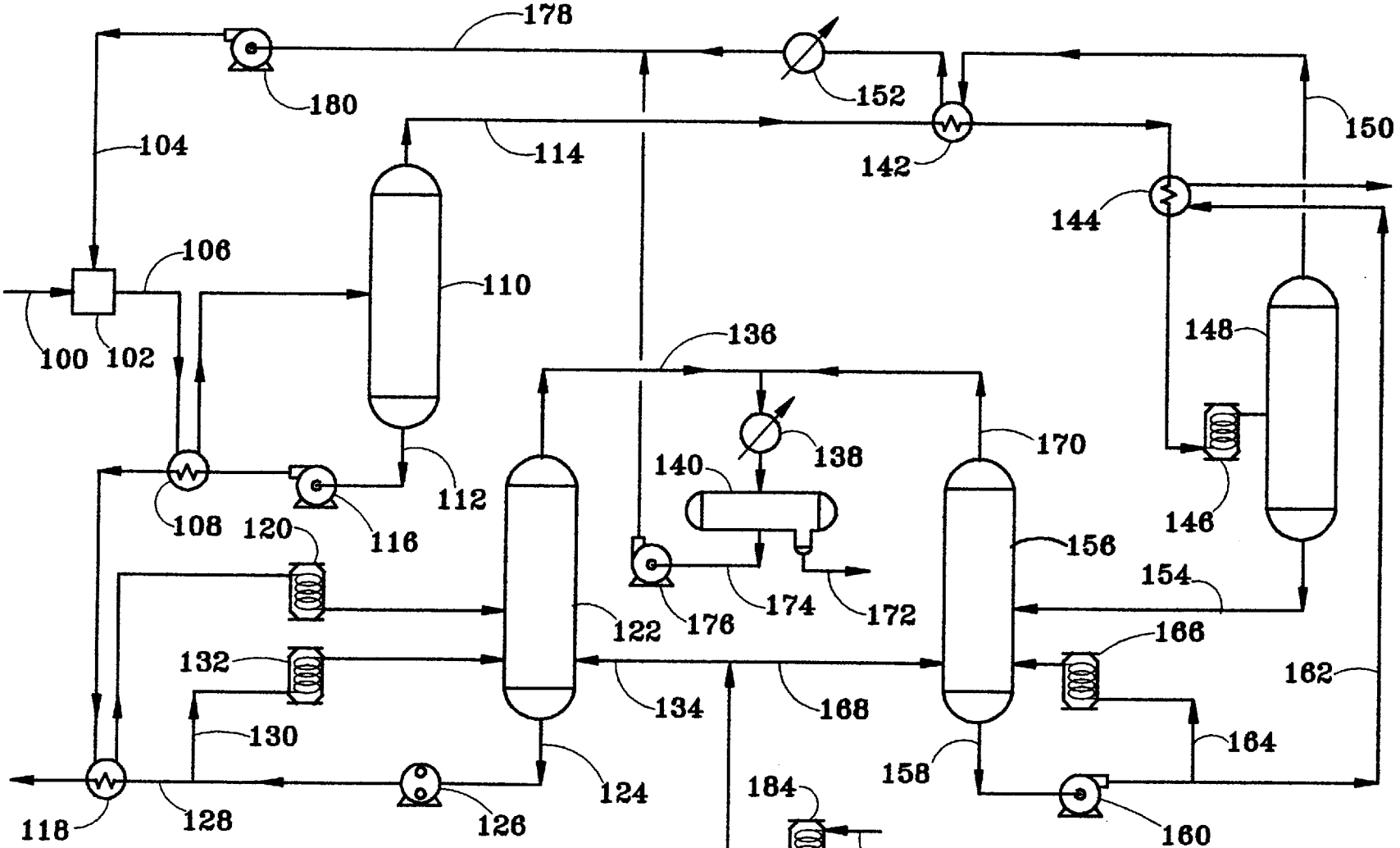
FIG. 1 is a simplified process flow diagram for a typical residuum oil solvent extraction process according to the present invention.

In a typical residuum oil solvent extraction process as illustrated in FIG. 1, a residuum oil is fed in line 100 to a mixer 102 where it is mixed with solvent supplied via line 104 to obtain a mixture in line 106. The mixture in line 106 is cooled in exchanger 108 and fed to asphaltene separator 110 which separates the mixture into a bottoms stream 112 and an overhead stream 114. Bottoms stream 112 is a mixture of asphaltenes and some solvent, whereas overhead stream 114 comprises a mixture of the deasphalted oil (DAO) and the bulk of the solvent. The bottoms stream 112 is pumped by pump 116, heated in exchangers 108 and 118, passed through convection heating coils 120 and fed to asphaltene stripper 122. A bottoms stream 124 is pumped via pump 126 into lines 128, 130. An asphaltenes product in line 128 is cooled in heat exchanger 118. A recirculated asphaltenes stream in line 130 is heated in convection heating coils 132 and recirculated to the asphaltenes stripper 122. Superheated steam is supplied to the asphaltenes stripper 122 via line 134. An overhead stream is obtained from the asphaltenes stripper 122 in line 136 which comprises solvent and water which is condensed in condenser 138 and collected in solvent surge drum 140.

Overhead stream 114 is heated in cross exchanger 142, cross exchanger 144 and convection heating coils 146, and fed to DAO separator 148. An overhead stream from the DAO separator 148 is obtained in line 150, cooled in cross exchanger 142 against the solvent-DAO phase in line 114, and further cooled in heat exchanger 152. A bottoms stream from the DAO separator 148 comprising primarily DAO and some residual solvent is passed via line 154 into DAO stripper 156. A bottoms stream 158 is pumped via pump 160 into lines 162, 164. A deasphalted oil product in line 162 is cooled in cross exchanger 144. A recirculated DAO stream in line 164 is heated in convection heating coils 166 and recirculated to the DAO stripper 156. Superheated steam is supplied to the DAO stripper 156 via line 168. An overhead stream is obtained from the DAO stripper 156 in line 170 which comprises solvent and water which is condensed in condenser 138 and collected in solvent surge drum 140 with the solvent and water from the asphaltenes stripper 122 via line 136. Water is removed from a dip leg of the surge drum 140 via line 172. Solvent is recirculated from the surge drum 140 via line 174 and pump 176 into line 178 with the cold solvent from heat exchanger 152. The combined solvent in line 178 can be pumped via pump 180 into line 104 for supply to the mixer 102 as described above.

Steam is supplied in line 182 and superheated in convection heating coils 184 for supply to lines 134, 168 as described above.

Figure 3:
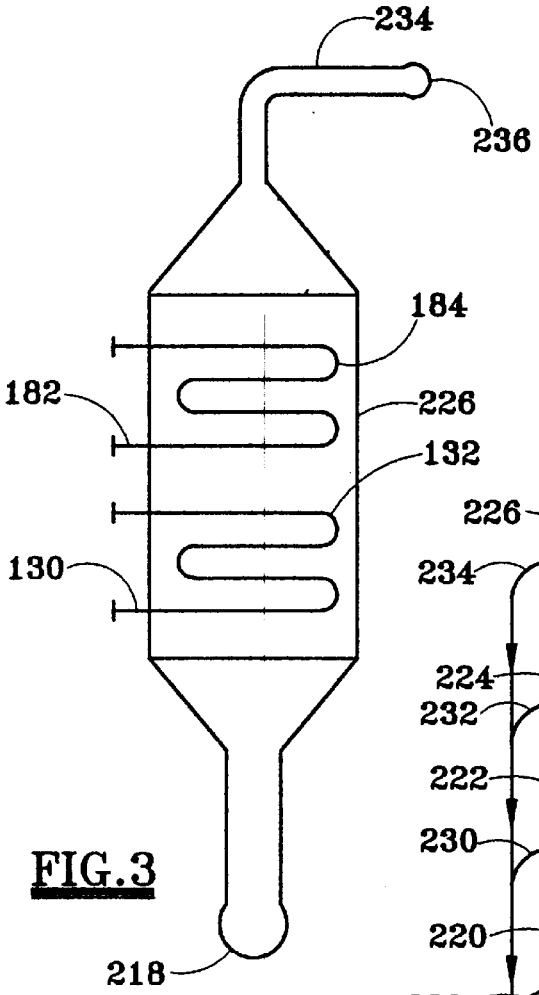
FIG. 3 is a schematic elevation of one of the parallel convection heating sections in the direct fired convection heater of FIG. 2.
Figure 2:
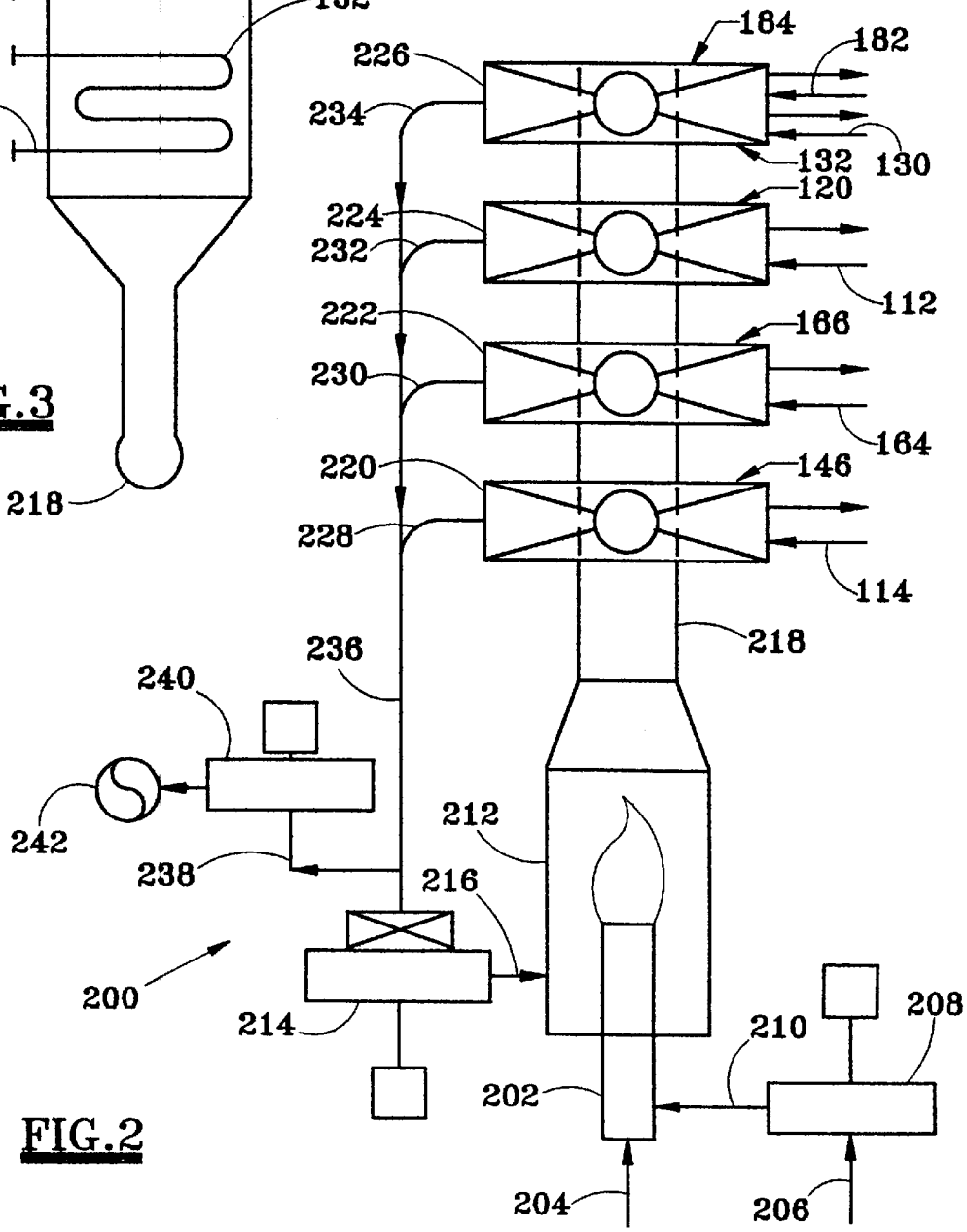
FIG. 2 is a schematic plan view of a direct fired convection heater according to an embodiment of the present invention.

With reference to FIGS. 2 and 3 wherein like reference numerals are used to indicate like parts, the direct fired convection heating system 200 according to one embodiment of the present invention burns fuel and air to mix with recirculated flue gas and form a hot flue gas for heating the convection heating coils 120, 132, 146, 166 and 184. Fuel is supplied to burner 202 via line 204. Air, which may be oxygen-enriched, is supplied via intake 206, fan 208 and duct 210. Recirculated flue gas is supplied to the burner housing 212 via recirculation fan 214 and duct 216. The fuel, combustion air and recirculated flue gas are proportioned to obtain the desired combustion temperature and flow rate of flue gas. Preferably, the flue gas leaving the burner housing 212 and entering hot flue gas supply duct 218 has a temperature between 800° F. and 1400° F. Low temperatures are desirable to reduce the nitrogen oxides formed in the combustion process and to reduce the temperature to which the process fluids may be exposed. On the other hand, higher temperatures are desirable to reduce the flow rate of the flue gas needed for the heating steps and to reduce the surface area of the heat transfer tubes or coils which is needed.

Flue gas from the supply duct 218 is supplied to the heat transfer zones 220, 222, 224, 226 in parallel to heat the respective convection heating coils 146, 166, 120, 132/184 through which process fluids are supplied via respective lines 114, 164, 112, 130 and steam via line 182 for superheating. As the flue gas passes through each of the heat transfer zones, the fluid in the respective coil is heated and the flue gas is cooled. The cooled flue gas is collected in return manifold lines 228, 230, 232, 234. A return header 236 supplies the flue gas to the recirculation fan 214. A portion of the flue gas is withdrawn from the return manifold 236 via line 238 and exhaust fan 240 for discharge in stack 242.

EXAMPLE

A residuum oil solvent extraction process using the direct fired combustion heater as illustrated in FIGS. 1–3 was designed with a processing rate of 35,000 barrels per day residuum oil. The direct fired convection heating system 200 had a flue gas temperature in the supply duct 218 of 1185° F. Film temperatures in coils 146, 166, 120, and 132 were maintained below 650° F. to minimize tube failures and coking inside the tubes.

The coils 146 had a design OD of 6.625 inches, a wall thickness of 0.378 inches and an effective length of 19 feet. The coils 146 were arranged in twelve tubes per row, with twelve passes. Fourteen of the rows were provided with five fins per inch, each measuring 0.75 inches high by 0.05 inches thick. The flow of solvent-DAO through the tubes was countercurrent to the flue gas. The flue gas had an outlet temperature of 379.4° F. The process fluid had an inlet temperature of 314° F. and an outlet temperature of 335° F. The flue gas pressure drop was 1.34 inches of water. The process fluid pressure drop was 11.0 psi. The convection zone 220 had a width of 149 inches and a height of 15 feet. The heat transfer was calculated at 83.0 MMBTU per hour.

The coils 166 were designed as nominal 4-inch schedule 40 5 Cr-½ Mo steel with an effective length of 19 feet. The coils 166 were arranged in six tubes per row, with six passes. Twenty-two rows were finned as follows: two rows with 2 fins/in., 0.25-in. high; two rows with 2.5 fins/in., 0.25-in. high; two rows with 3 fins/in., 0.25-in high; two rows with 4 fins/in., 0.25-in. high; two rows with 5 fins/in., 0.25-in. high; two rows with 4 fins/in., 0.375-in. high; two rows with 5 fins/in., 0.375-in. high; and eight rows with 5 fins/in., 0.5-in. high. The flow of DAO through the tubes was cocurrent with the flue gas. The flue gas had an outlet temperature of 672° F. The process fluid had an inlet temperature of 500° F. and an outlet temperature of 580° F. The flue gas pressure drop was 4.1 inches of water. The process fluid pressure drop was 7.36 psi. The convection zone 222 had a width of 52 inches and a height of 17 feet. The heat transfer was calculated at 28.845 MMBTU per hour.

The coils 120 were designed with an OD of 4.5 inches, a wall thickness of 0.295 inches and an effective length of 19 feet. The coils 120 were arranged in six tubes per row, with six passes. Twenty-four of the rows were provided with five fins per inch, each measuring 0.05 inches thick, two having fins 0.25-in. high, two having fins 0.5-in. high, and twenty having fins 0.75-in. high. The flow of asphaltenes through the tubes was countercurrent to the flue gas. The flue gas had an outlet temperature of 400° F. The process fluid had an inlet temperature of 343.3° F. and an outlet temperature of 464° F. The flue gas pressure drop was 19.97 inches of water. The process fluid pressure drop was 7.08 psi. The convection zone 224 had a width of 52 inches and a height of 17 feet. The heat transfer was calculated at 35.7 MMBTU per hour.

The coils 132 were designed with an OD of 4.5 inches, a wall thickness of 0.237 inches and an effective length of 19 feet. The coils 132 were arranged in six tubes per row, with three passes. Sixteen rows were bare without fins. Four rows had 1 fin per inch, 0.25 inches high. Two rows had 2 fins per inch, 0.25 inches high. Two rows had 4 fins per inch, 0.25 inches high. Two rows had 4 fins per inch, 0.25 inches high. Two rows had 5 fins per inch, 0.375 inches high. Eight rows had 5 fins per inch, 0.75 inches high. All fins were 0.05 inch-thick carbon steel. The flow of asphaltenes through the tubes was cocurrent with the flue gas. The flue gas had an outlet temperature of 623° F. The process fluid had an inlet temperature of 525° F. and an outlet temperature of 580° F. The flue gas pressure drop was 1.0 inch of water. The process fluid pressure drop was calculated at 75 psi.

The coils 184 were designed with an OD of 4.5 inches, a wall thickness of 0.207 inches and an effective length of 19 feet. The coils 184 were arranged in six tubes per row, with three passes. Nine of the rows were provided with 5 fins per inch, each measuring 0.05 inches high by 0.75 inches thick. The flow of steam through the tubes was countercurrent to the flue gas. The flue gas had an inlet temperature of 623° F. and an outlet temperature of 471° F. The flue gas pressure drop was 0.5 inches of water. The steam pressure drop was calculated at 14.4 psi.

The convection zone 226 had a design width of 52 inches and a height of 29 feet. The heat transfer was calculated at 16.9 MMBTU per hour.

A capital cost comparison was made between the shell and tube-based hot oil system and the fired heating of this example. The fired heater eliminates seven shell and tube heat exchangers at an installed cost of about $3,500,000 (all costs are in 1995 U.S. dollars), and the hot oil heater at an installed cost of about $2,750,000. The installed cost of the convection heating system 200 is about $2,750,000. Thus, the estimated capital cost savings are about $3,500,000, even without considering the savings from eliminating the hot oil piping system (relative to the direct fired system) and the cost of the hot oil pumps, storage tanks and the like. Moreover, tube plugging problems are greatly reduced, and reduced maintenance thus represents additional cost savings. Also, fired tubes can be expected to last 20 years, whereas the shell and tube exchangers of the prior art hot oil system have an expected lifetime of only 10 years.

The foregoing invention is illustrated by way of reference to the embodiment described. Various modifications may be made to the invention in view of the above disclosure by those skilled in the art. It is intended that all such modifications and variations within the scope and spirit of the appended claims be embraced thereby.

I claim:

1. In a residuum oil solvent extraction process comprising the steps of 1) contacting residuum oil with a light hydrocarbon solvent at an elevated subcritical pressure and temperature, 2) separating a mixed solvent-deasphalted oil (DAO) phase from an asphaltene phase, 3) heating the asphaltene phase from step (2) and steam stripping the heated phase to form an asphaltene product stream, 4) heating the solvent-DAO phase from step (2) to above the equilibrium temperature of the solvent to effect separation of the solvent-DAO phase into a solvent phase and a DAO phase, 5) recovering the DAO phase and 6) heating the DAO phase from step (5) and steam stripping the heated DAO phase to form a DAO product stream, the improvement which comprises the steps of:

(a) burning fuel and air in a combustion zone to mix with recirculated flue gas and form a hot flue gas;

(b) supplying the hot flue gas from step (a) to a convection heating zone;

(c) passing the asphaltene phase of step (2) tubeside through the convection heating zone to heat, in step (3), the asphaltene phase to provide the heated phase for steaming stripping to form the asphaltene product stream and cool the flue gas, (d) passing the solvent-DAO phase of step (2) tubeside through the convection heating zone to heat, in step (4), the solvent-DAO phase to above the equilibrium temperature of the solvent to effect separation of the solvent-DAO phase into the solvent phase and the DAO phase and cool the flue gas;

(e) passing the DAO phase of step (5) tubeside through the convection heating section to heat, in step (6), the DAO phase to provide the heated phase for steam stripping to form the DAO product stream and cool the flue gas;

(f) collecting the cooled flue gas from steps (c), (d) and (e) and recirculating a portion thereof to the combustion zone in step (a).

2. The improvement of claim 1, wherein step (c) comprises passing the tubeside fluids and hot flue gas through a plurality of respective convection heating sections operated in parallel.

3. The improvement of claim 1, wherein step (3) of the process includes heating and recirculating a portion of the asphaltene product stream to the asphaltene stripping, wherein the recirculated asphaltene is heated by passage tubeside through the convection heating zone in step (c).

4. The improvement of claim 1, wherein the process includes the step of 7) superheating steam for stripping in steps (3) and (6), wherein the steam is superheated by passage tubeside through the convection heating section in step (c).

5. The improvement of claim 1, wherein the hot flue gas from step (a) has a temperature from 800° F. to 1400° F.

6. In a residuum oil solvent extraction process comprising the steps of 1) contacting residuum oil with a light hydrocarbon solvent at an elevated subcritical pressure and temperature, 2) separating a mixed solvent-deasphalted oil (DAO) phase from an asphaltene phase, 3) heating the asphaltene phase from step (2) to form a first hot asphaltene stream, 4) feeding the first hot asphaltene from step (3) to an asphaltene steam stripping unit to form an asphaltene product steam essentially free of solvent, 5) heating a portion of the asphaltene product stream from step (4) to form a second hot asphaltene stream, 6) feeding the second hot asphaltene stream to the asphaltene steam stripping unit in step (4), 7) heating the mixed solvent-DAO phase from step (2) to above the equilibrium temperature of the solvent to effect separation of the mixed solvent-DAO phase into a solvent phase and a solvent-lean DAO phase, 8) recovering the solvent-lean DAO phase separated in Step (7), 9) heating the solvent-lean DAO phase from step (8), 10) steam stripping the hot solvent-lean DAO phase from step (9), 11) superheating steam for use in steps (4) and (10), the improvement which comprises the steps of:

(a) burning fuel and air in a combustion zone to mix with recirculated flue gas and form a hot flue gas;

(b) supplying the hot flue gas to a convection heating zone comprising a plurality of parallel convention heating sections;

(c) passing the asphaltene phase from step (2) tubeside through one of the convection heating sections to heat, in step (3), said asphaltene phase and form the first hot asphaltene stream and cool the flue gas;

(d) passing the mixed solvent-DAO phase from step (2) tubeside through one of the convection heating sections to heat, in step (7), said mixed solvent-DAO phase to above the equilibrium temperature of the solvent to effect the separation of said mixed solvent-DAO phase into said solvent phase and said DAO phase and cool the flue gas;

(e) passing the solvent-lean DAO phase from step (8) tubeside through one of the convection heating sections to heat, in step (9), said solvent-lean DAO phase and form the hot solvent-lean DAO phase subjected to steam stripping the step (10) and cool the flue gas;

(f) passing the portion of the asphaltene product stream from step (4) tubeside through one of the convection heating sections to heat, in step (5), said portion of the asphaltene product stream and form the second hot asphaltene stream fed to the asphaltene stripping unit in step (4) and cool the flue gas;

(g) passing steam tubeside through one of the convection heating sections to superheat, in the step (11), said steam for use in steps (4) and (10) and cool the flue gas;

(h) collecting the cooled flue gas from the convection heating sections; and (i) recirculating a portion of the collected flue gas from step (h) to step (a).

7. The improvement of claim 6, wherein the hot flue gas from step (a) has a temperature from 800° F. to 1400° F.

8. The improvement of claim 7, wherein the tubes for the passage of the asphaltenes and steam in steps (f) and (g) are arranged in series in one of the convection heating sections.

* * * * *